US010435983B1

(12) United States Patent
Tseytlin et al.

(10) Patent No.: US 10,435,983 B1
(45) Date of Patent: Oct. 8, 2019

(54) METHODS AND DEVICES FOR MAXIMIZING OIL PRODUCTION AND OIL RECOVERY FOR OIL WELLS WITH HIGH GAS-TO-OIL RATIO

(71) Applicants: Simon Tseytlin, Middle Village, NY (US); David Tseytlin, Brooklyn, NY (US)

(72) Inventors: Simon Tseytlin, Middle Village, NY (US); David Tseytlin, Brooklyn, NY (US)

( * ) Notice: Subject to any disclaimer, the term of this patent is extended or adjusted under 35 U.S.C. 154(b) by 0 days.

(21) Appl. No.: 16/253,116

(22) Filed: Jan. 21, 2019

(51) Int. Cl.

| | |
|---|---|
| ***E21B 34/06*** | (2006.01) |
| ***E21B 17/00*** | (2006.01) |
| ***E21B 47/06*** | (2012.01) |
| *E21B 34/02* | (2006.01) |

(52) U.S. Cl.
CPC ..... *E21B 34/06* (2013.01); *E21B 17/00* (2013.01); *E21B 47/06* (2013.01); *E21B 34/02* (2013.01)

(58) Field of Classification Search
CPC ..... E21B 17/00; E21B 34/02; E21B 34/06; E21B 34/08; E21B 34/101; E21B 34/105; E21B 43/121; E21B 47/06
See application file for complete search history.

(56) References Cited

U.S. PATENT DOCUMENTS

| | | | |
|---|---|---|---|
| 4,442,710 | A | 4/1984 | Meng |
| 5,105,889 | A | 4/1992 | Misikov |
| 5,752,570 | A | 5/1998 | Shaposhnikov |
| 5,871,047 | A | 2/1999 | Spath |
| 5,967,234 | A | 10/1999 | Shaposhnikov |
| 7,172,020 | B2 | 2/2007 | Tseytlin |
| 7,753,127 | B2 | 7/2010 | Tseytlin |

*Primary Examiner* — Robert E Fuller
*Assistant Examiner* — Christopher J Sebesta
(74) *Attorney, Agent, or Firm* — Boris Leschinsky

(57) ABSTRACT

A method for maximizing oil production rate from an oil well with high gas-to-oil ratio comprising a step of calculating an optimal bottomhole pressure and determining a well-specific geometry for a flow restrictor located at the bottomhole region of the oil well. The flow restrictor comprises at least a first stage tube and a second stage tube and has a fixed geometry calculated to cause self-regulation of the oil flow conditions so as to maintain the bottomhole pressure at a stable equilibrium level causing maximum oil rate production and increasing ultimate oil recovery from an oil well.

16 Claims, 6 Drawing Sheets

METHODS AND DEVICES FOR MAXIMIZING OIL PRODUCTION AND OIL RECOVERY FOR OIL WELLS WITH HIGH GAS-TO-OIL RATIO

BACKGROUND

Without limiting the scope of the invention, its background is described in connection with oil production. More particularly, the invention describes methods, computer models, and related devices aimed at maintaining the highest possible oil production for an oil well with high gas-to-oil ratio over the lifetime of the oil well.

The most advantageous implementation of the present invention is in wells with high Gas-to-Oil Ratio (GOR) defined as GOR greater than about 100 cubic meters of gas over cubic meters of oil, which is sometimes also referred to in other units as about 600 cubic feet of gas per barrel of oil, which is the same as above. Such oil wells may exhibit high and increasing production of gas accompanied by low and decreasing production of oil. In extreme cases, a gas flow regime may be formed with no oil exiting the oil well altogether—even despite adjustments of the surface choke, including either closing or opening thereof. At some point, the gas flow regime may exhaust the reservoir formation pressure and preclude any further oil production, whereby severely limiting a total oil recovery from a particular oil well and even from a particular reservoir formation.

This invention contains further improvements of my earlier U.S. Pat. Nos. 7,172,020 and 7,753,127, incorporated herein in their respective entireties by reference.

A conventional oil well is illustrated in FIG. 1 and includes an oil reservoir formation 1, which is reached by an oil well casing 6 with perforations 2 allowing oil to enter the internal space of the casing 6. An oil well tube 7 is lowered into the casing 6 and fixed at the bottomhole region by spacers 4 or other suitable means. The oil well tube 7 extends to the surface of the well with an adjustable surface choke 8 being used to control the flow of oil and gas from the oil well tube 7.

Optimization of oil production and increase in ultimate oil recovery from an oil well has been a goal of many innovative methods and devices of the prior art. Generally speaking, the bottomhole behavior of oil mixed with gas (and some other ingredients such as water, etc.) has been described in a series of mathematical equations by Muskat. One specific publication by Muskat is incorporated herein by reference in its entirety and describes the mathematical model of oil reservoir: Muskat M. "The Production Histories of Oil Producing Gas-Drive Reservoirs", published in the Journal of Applied Physics in March of 1945, p. 147-159.

For illustration purposes, a unidimensional axisymmetric system of Muskat equations with corresponding PVT characteristics of fluid and dependencies of relative permeability $K_{ro}$, $K_{rg}$ from liquid saturation ($S_o$) can be described as follows:

$$\frac{1}{r}\frac{\partial}{\partial r}\left(r\frac{k_{ro}}{\mu_o B_o}\frac{\partial p}{\partial r}\right) = -158.064\frac{\phi}{k}\frac{\partial}{\partial t}\left(\frac{S_o}{B_o}\right) \tag{1}$$

$$\frac{1}{r}\frac{\partial}{\partial r}\left[r\left(\frac{k_{rg}}{\mu_g B_g} + \frac{Rs}{5.615}\frac{k_{ro}}{\mu_o B_o}\right)\frac{\partial p}{\partial r}\right] = -158.064\frac{\phi}{k}\frac{\partial}{\partial t}\left(\frac{S_g}{B_g} + \frac{S_o}{B_o}\frac{Rs}{5.615}\right)$$

where: P—pressure in formation; $S_o$—oil saturation in formation; $S_g$—gas saturation in formation; $R_s$—solution of gas in oil; $B_o$—oil formation volume factor; $B_g$—gas formation volume factor; $\mu_o$—oil viscosity; $\mu_g$—gas viscosity; φ—formation porosity; K—formation permeability.

For practical purposes, Vogel had simplified the Muskat equations and adapted them to the calculations of oil producing formations. These equations are known as Vogel model and have subsequently been modified by others. One example of such publication is as follows: Vogel, *Inflow Performance Relationships for Solution-Gas Drive Wells*, as published in Journal of Petroleum Technology, January 1968, pp. 83-92, incorporated herein in its entirety by reference. Unfortunately, Vogel model does not work well in wells with high gas-to-oil ratio. According to Vogel, the dependency of oil rate production of bottomhole pressure is a constantly diminishing parabolic curve with a production peak at zero value of the bottomhole pressure, see for example FIG. 2 of the above-mentioned article. In other words, the lower the bottomhole pressure, the higher the oil rate production from the formation. This is a gross simplification of the bottomhole processes in the formation. In fact, if the bottomhole pressure falls below saturation pressure in case of high GOR, relative permeability coefficient by oil decreases because of gas saturation increase, which in turn is a result of gas being released from oil. Viscosity of so degassed oil also increases. This leads to a decrease of productivity index of formation. This phenomenon affects the oil production rate more than the increasing depression. As a result, decreasing of the bottomhole pressure below saturation pressure can lead to a decrease in oil production rate, rather than to its increase as predicted by Vogel's model, see FIG. 2. In some extreme cases, reliance on Vogel's model will cause a complete switch in production from oil to gas. There is a need therefore for a method allowing calculating the oil production rate in high GOR wells with better accuracy then that allowed by Vogel's model.

It is also known that producing oil wells with high GOR (Gas-to-Oil Ratio) often lose their stability, and this process is accompanied by a sharp increase in GOR. Any attempts to stop this process by using a surface choke or other surface manipulations usually fail, and the oil well gradually switches into a gas production mode. The physics of this process can be explained as follows: in case when a gas cone covers some holes of a perforated section of the well casing 6, quite often that oil well loses stability. This, in turn, leads to a continuing slow increase of the cone height followed by an increase in the gas stream and a decrease in the oil flow. This process continues until the well is completely switched to a gas mode. Even if a switch to a gas mode does not happen, the instability of the well does not allow efficient control of the bottomhole pressure by using a choke at the surface. Similar detrimental phenomena can occur because of formation of a gas skin effect near the bottom of the well. The physics of the skin effect is described in detail in my U.S. Pat. No. 7,172,020. It also shows that this phenomenon leads to a non-conventional shape of the IPR curve (Inflow Pressure Relationship, i.e. the dependence of well oil flow rate of the bottomhole pressure). A notable feature of this curve is the presence of a certain threshold value of the bottomhole pressure (called "$P_{opt}$—optimal pressure"), at which the greatest possible oil flow rate from a reservoir can be achieved (FIG. 2).

The need exists therefore for methods and devices for continuously producing oil at a maximum possible rate over the life of the oil well in a stable and predictable manner—including in oil wells in high GOR and even in the presence of gas cone and gas skin effects.

SUMMARY OF THE INVENTION

Accordingly, it is an object of the present invention to overcome these and other drawbacks of the prior art by providing novel methods for maximizing oil recovery from an oil well with high GOR.

It is another object of the present invention to provide methods and devices for maximizing oil production from an oil well without the need to adjust the bottomhole parameters with changing reservoir conditions.

It is a further object of the present invention to provide a mathematical model to determine the optimal level of bottomhole pressure for an oil well producing oil at a maximum rate.

It is yet a further object of the present invention to provide a mathematical model for calculating the optimal level of bottomhole pressure to assure the maximum rate of oil production over the lifetime of the oil well.

The method of the inventions in general comprises the steps of calculating an optimal level of bottomhole pressure for a given oil well and determining an optimal design for a well-specific flow restrictor. The flow restrictor is designed to assure the bottomhole pressure remaining at the optimal level when the oil well is producing oil following installation of the flow restrictor at the bottomhole region of the oil well.

The geometry of the flow restrictor may be selected to assure a stable equilibrium of the bottomhole pressure despite changing reservoir conditions so that none or only minimal adjustments of the surface choke may be sufficient for maximizing oil production rate for an extended period of time.

The flow restrictor is further designed to have no moving parts or other ways to adjust its geometry—so that the operation of such oil well equipped with the flow restrictor of the present invention is greatly simplified, while avoiding interruptions in oil production typically needed for adjustment of the bottomhole equipment of the prior art.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE PREFERRED EMBODIMENT OF THE INVENTION

Figure 1:
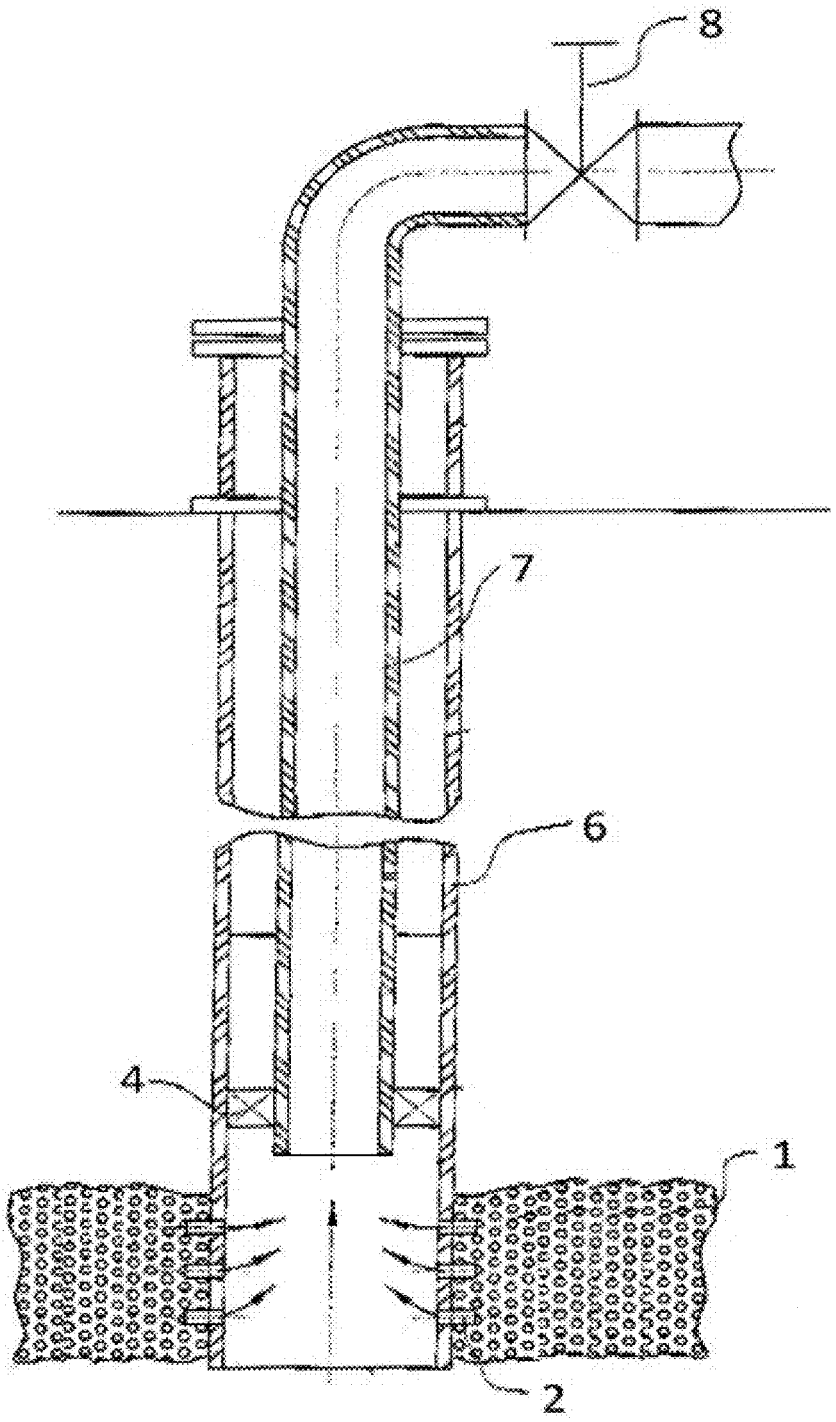
FIG. 1 (PRIOR ART)
FIG. 1 is a general side view of the oil well of the prior art.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Figure 2:
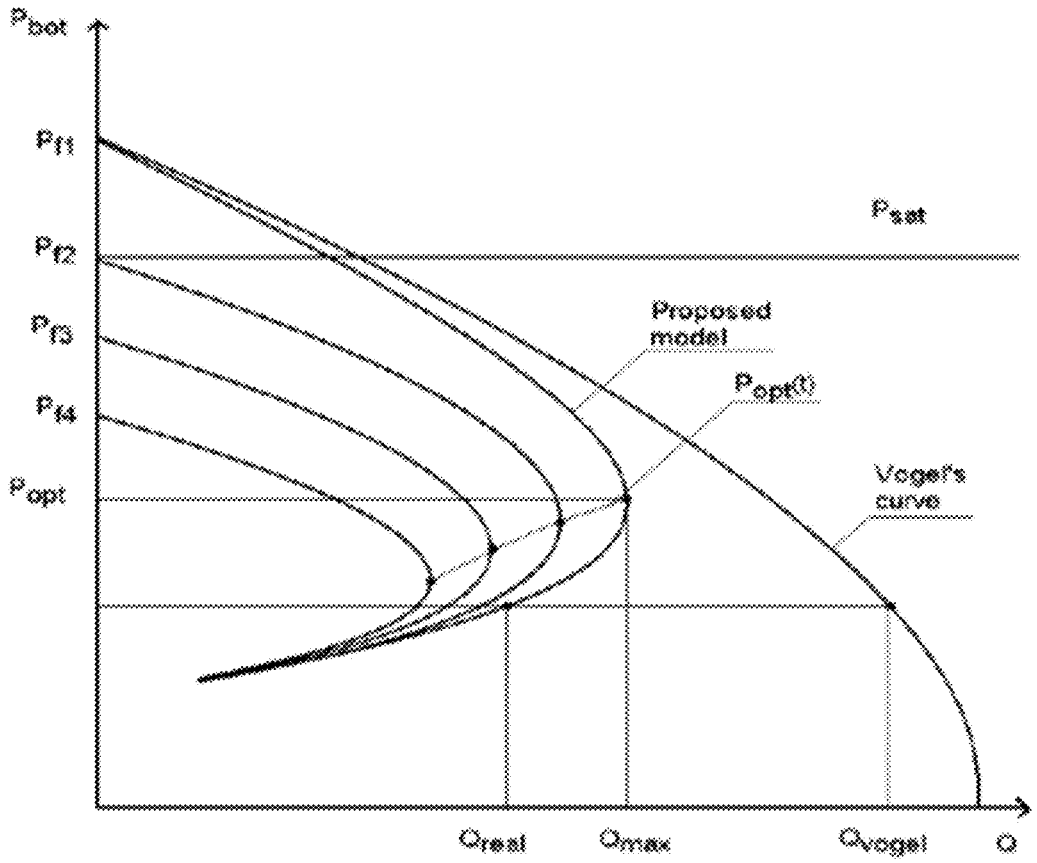
FIG. 2 is a pressure-flow chart showing a comparison of the prior art Vogel and novel proposed relationship of the bottomhole pressure and the rate of oil production.

As illustrated in FIG. 2, it was unexpectedly discovered that oil production in oil wells with high GOR does follow the gradually declining Vogel curve as a function of bottomhole pressure, but rather exhibits a certain maximum at the point of optimal bottomhole pressure level. The optimal level of bottomhole pressure may differ from the initial point over the life of the oil well but in general can be calculated using a mathematical model of oil production accounting the reservoir as well as the oil well parameters.

It was also unexpectedly discovered that in order to maintain the operation of the oil well at the calculated optimal point of maximum oil production, there is a need to install a certain flow restrictor at the bottom of the oil well—which allows for reaching that maximum rate of oil production and adjustment of the bottomhole pressure using a surface choke, if necessary.

While conceptually the use of a bottomhole flow restrictor has been described in my previous patents, its design was complicated and accounted for a perceived need to adjust its geometry from a surface of the well, making the flow restrictor complex and expensive in manufacturing. The present invention improves on that concept and describes a novel flow restrictor with fixed geometry which has no moving parts and does not require adjustments caused by operation of the flow restrictor from a surface of the well.

Figure 3:
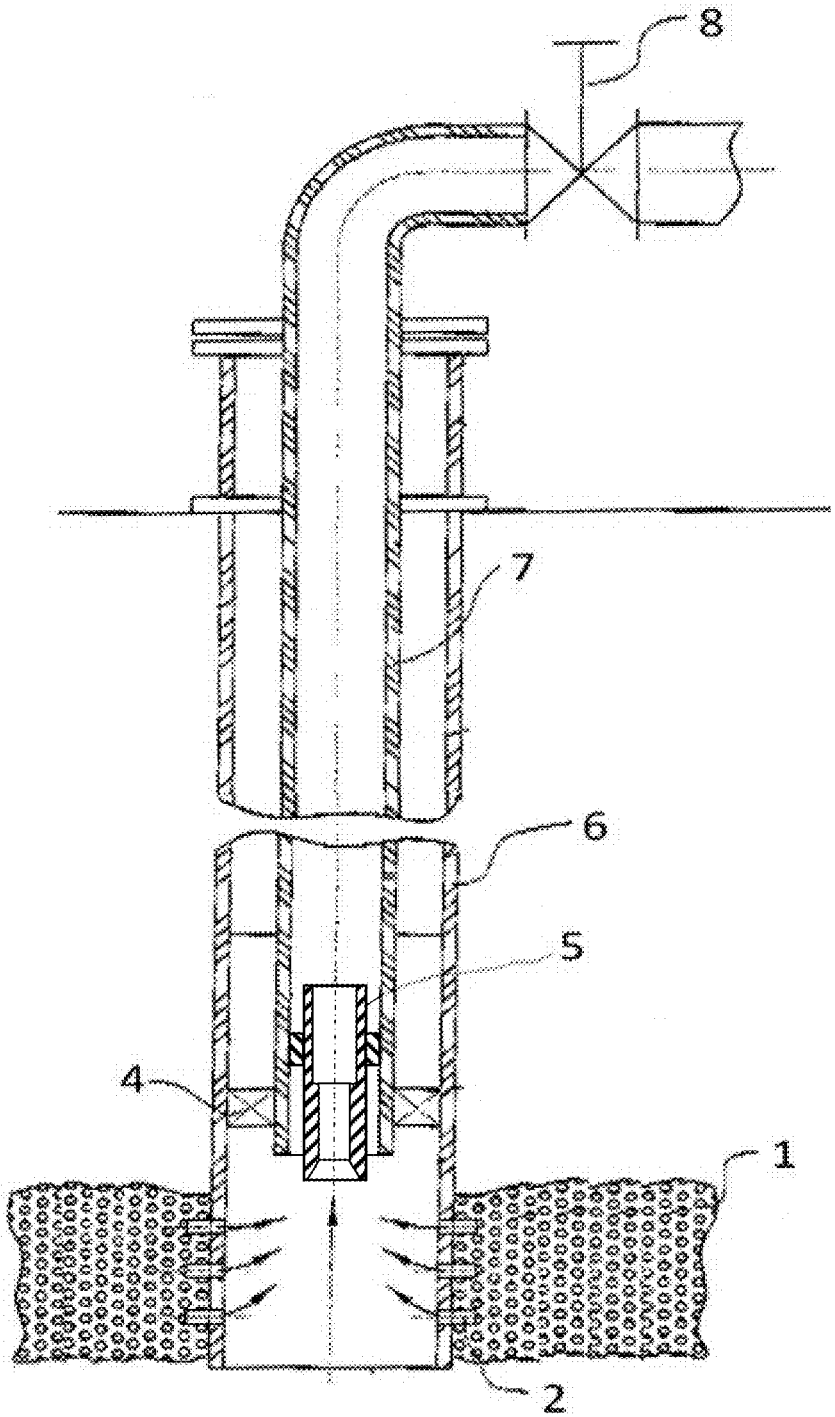
FIG. 3 shows schematically the location and a general design of the flow restrictor placed at the bottomhole region of an oil well.
Figure 4:
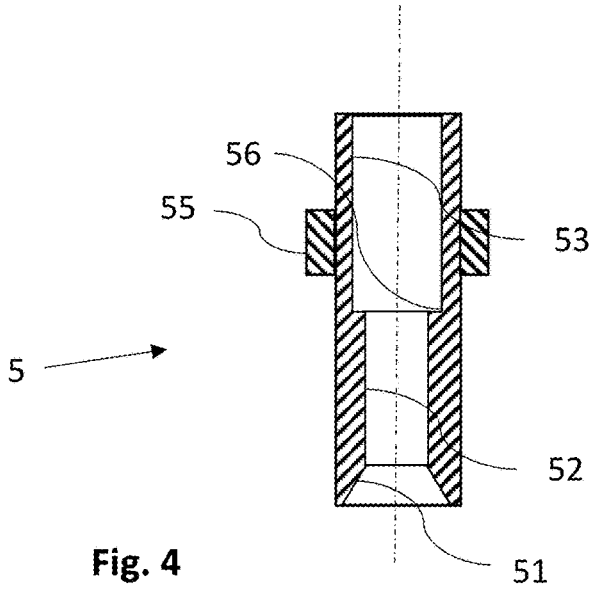
FIG. 4 shows a close-up of the restrictor shown in FIG. 3.

The novel fixed geometry flow restrictor 5 of the present invention is generally shown at the bottomhole region of the oil well in FIG. 3, with the enlarged illustration thereof in FIG. 4. In embodiments, the flow restrictor 5 comprises at least two sections, a first (lower) stage tube 52 and a second (upper) stage tube 53. The area of flow entrance 51 into the first stage tube 52 may feature a gradual transition such as a tapered transition as shown in the drawings. The flow restrictor 5 may be fixed at the bottom of the oil well using spacers 54. At least in some embodiments, a transition between the first stage 52 and the second stage 53 may be abrupt and feature a stepped enlargement in geometry 56.

Both first and second stage tubes 52 and 53 may be calculated to have certain dimensions which are specific for a particular oil well and a particular oil reservoir. In general, the geometry of the flow restrictor may be determined to satisfy all of the following criteria:

1. the pressure drop across the flow restrictor 5 may not exceeding about 12% of a current reservoir formation pressure while the oil well is producing the oil at the maximum oil flow rate. In embodiments, the pressure drop across the flow restrictor 5 may be anywhere between 1% and 12%, such as 1, 2, 3, 4, 5, 6, 7, 8, 9, 10, 11, and 12%, or any value inbetween as the invention is not limited in this regard;
2. The first stage tube may be round, oval, or any other suitable shape in its cross-section. It may also have a constant cross-sectional shape and size along its length or variable cross-sectional shape and size along its length as long as it satisfies the first criteria. For simplicity, the guidance for the shape of the first stage tube may be provided as a diameter and a length, which may be calculated differently for different classes of oil wells as follows:
   - for oil wells producing less than about 100 barrels of oil per day, the first stage tube may have a diameter from about 2 mm to about 4 mm such as 2, 2.5, 3, 3.5, 4 mm or any value inbetween; while the length of the first stage tube may be selected to be from about 4 cm to about 6 cm, such as 4, 4.5, 5, 5.5, 6 cm or any number inbetween;
   - for oil wells producing higher levels of oil such as about 100 to 1,000 barrels of oil per day, the first stage tube may have a diameter from about 4 mm to about 8 mm such as 4, 5, 6, 7, 8 mm or any number inbetween; and a length from about 6 cm to about 8 cm such as 6, 6.5, 7, 7.5, 8 cm or any value inbetween; and finally
   - for oil wells producing over 1,000 barrels of oil per day, the first stage tube may have a diameter from about 8 mm to about 20 mm such as 8, 9, 10, 11, 12, 13, 14, 15, 16, 17, 18, 19, 20 mm or any number inbetween; and a length from about 8 cm to about 10 cm such as 8, 8.5, 9, 9.5, 10 cm or any value inbetween;
3. The second stage tube may be selected with a diameter about 1.05 to 1.5 times greater than the diameter of the first stage tube such as 1.05, 1.1, 1.15, 1.2, 1.25, 1.3, 1.35, 1.4, 1.45, 1.5 times greater of any value inbetween and a shorter length of about 0.5 to 0.95 times the length of the first stage tube such as 0.5, 0.6, 0.7, 0.8, 0.9, 0.95 or any value inbetween.

The novel method of the invention may therefore include a step of calculating the optimal level of the bottomhole pressure, providing a flow restrictor as described above, installing the flow restrictor at the bottomhole region of the oil well and producing oil with this flow restrictor in place.

The step of determining the geometry of the flow restrictor 5 may include a step of calculating oil flow and gas flow parameters throughout the flow restrictor 5 and the oil well 7 by using a mathematical model of two-phase flow proceeding in three consecutive flow regimes:

i. a first flow regime starting from the oil reservoir and proceeding through a first stage tube 52 of the flow restrictor 5;

ii. a second flow regime proceeding through the second stage tube 53 of the flow restrictor 5; and iii. a third stage flow regime proceeding after exit from of flow from the second stage tube 53 and traveling through the remaining portion of the oil well 7, whereby flow exit conditions from the preceding flow regime form a corresponding set of entry conditions for the subsequent flow regime.

In embodiments, the same set of mathematical equations may be used to calculate flow regime and parameters at each of the first flow regime, the second flow regime, and the third flow regime. For example, a mathematical model of a two-phase flow regime in a cylindrical tube may be used for that purpose. Exemplary mathematical equations for such two-phase flow calculations may be found in Aziz K. and el., The Journal of Canadian Petroleum Technology, July-September 1972, p. 38-49, entitled "Pressure Drop in Wells Producing Oil and Gas".

In oil wells where water is present in substantial amounts in addition to oil and gas, mathematical equations describing a three-phase flow may be used. Since every flow regime may be calculated individually, the optimal bottomhole pressure level may be calculated as a sum or respective consecutive pressure drops of the first flow regime, the second flow regime, and the third flow regime. To satisfy the first condition listed above, such sum of pressure drops over the three flow regimes may be selected to be not less than about 88 percent of the current reservoir formation pressure.

Figure 6:
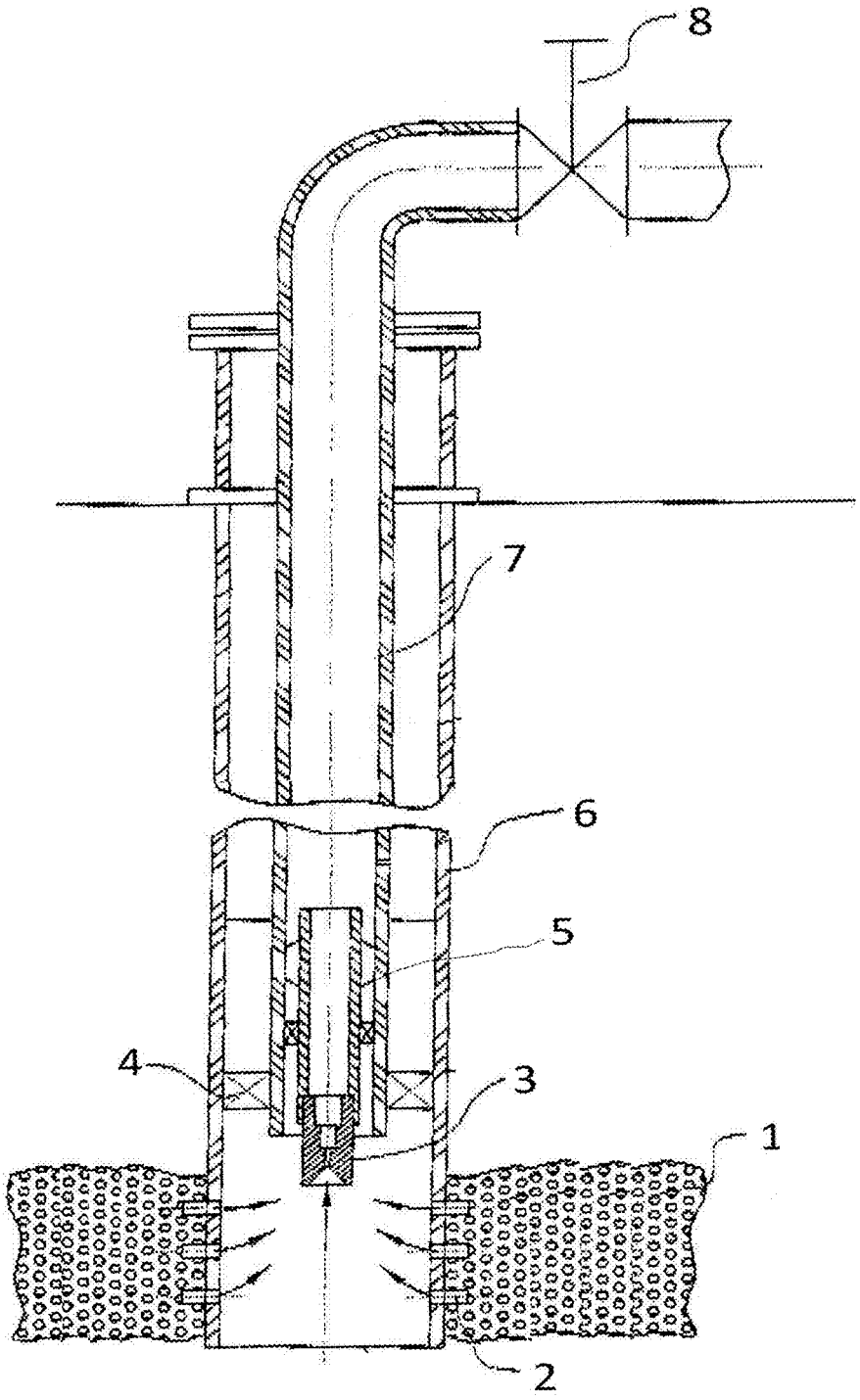
FIG. 6 shows an alternative design of the flow restrictor of the present invention with a plurality of additional stages.

FIG. 6 shows further embodiments of the present invention where a third stage or more stages may be added to the flow restrictor 5, for example as a separate attachment 3. The third stage dimensions may be determined for example in relationship to the second stage dimensions as follows: the third stage tube diameter may be selected to be about 1.05 to 1.5 times greater than the diameter of the second stage tube such as 1.05, 1.1, 1.15, 1.2, 1.25, 1.3, 1.35, 1.4, 1.45, 1.5 times greater of any value inbetween; and a shorter yet length of the third stage may be selected to be about 0.5 to 0.95 times the length of the second stage tube such as 0.5, 0.6, 0.7, 0.8, 0.9, 0.95 or any value inbetween.

The flow restrictor design of the present invention is based on a new understanding of the processes surrounding any deviation of the oil production from initial optimal level, which can be achieved by using a flow restrictor of the predetermined geometry defining its flow characteristics. Discussion of the processes occurring at the bottom of the oil well when the bottomhole pressure deviates from its intended optimal level is critical for understanding of the design of the flow restrictor which does not require any moving parts for its operation.

Figure 5:
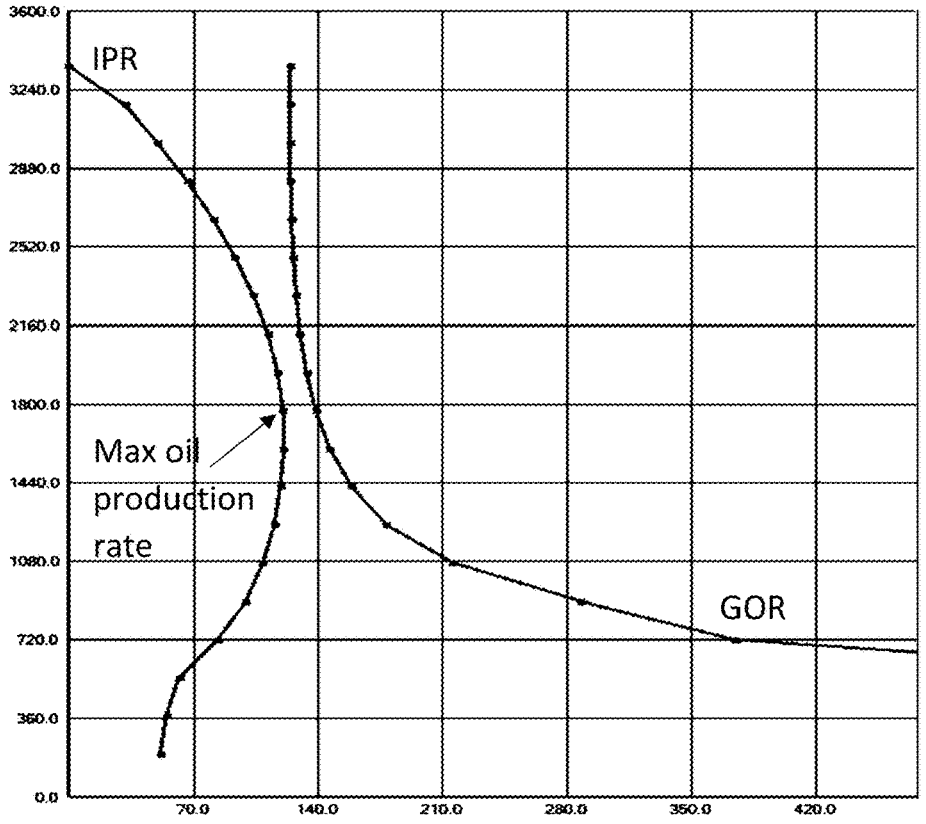
FIG. 5 shows an IPR curve overlaid with a GOR curve for a proposed oil well with the flow restrictor of the invention positioned therein.

Reference is made now to FIG. 5 showing an exemplary calculated IPR curve superimposed onto a GOR curve in a space defined by bottomhole pressure and the oil flow rate coordinates. As the oil production rate increases with decreasing of the bottomhole pressure following an IPR curve from the top point corresponding to the reservoir formation pressure, it reaches a maximum level at the point marked with an arrow. All throughout that process, the GOR value remains at or about the initial level and not changing much as the bottomhole pressure reaches the optimal level, as the GOR curve is essentially close to a vertical line in that region of the chart. From the point of reaching the maximum oil production rate and further below thereof, however, as the bottomhole pressure and the oil rate continue to decrease, the GOR curve exhibits a sharp increase at the bottom right corner of the chart, indicating a rapidly increasing amount of gas entering the oil well.

According to the present invention, as the bottomhole pressure decreases and the GOR raises to a higher level, the flow restrictor causes the flow regime in at least one of the first stage or a second stage to change from a bubble type two-phase flow to a slug type two-phase flow. The increase in the amount of gas traversing the flow restrictor is causing a rapid increase in its flow resistance, which in turn causes the increase in the bottomhole pressure and therefore urging the oil production rate to shift back up in the direction of the maximum oil production rate. This in turn causes the GOR to decrease again to get closer to its level corresponding to the maximum oil production rate. The gas component of the two-phase flow is therefore decreasing, and the equilibrium is maintained.

This unique behavior is therefore assuring the maximum oil production rate to be a stable equilibrium point on the IPR curve—whereby any deviations and changes in reservoir conditions are mitigated by the flow restrictor 5 of the invention as to maintain the oil rate at a desired maximum production point. Because of this behavior, there is no need to adjust the geometry of the flow restrictor from the surface and no need to interrupt the oil production from the oil well for maintaining the production rate at the desired maximum level.

Not only the operation of the oil well is intrinsically optimal over extended periods of time and may continue without interruptions, but the present invention therefore may be used to maximize the ultimate oil recovery from the oil well over the life of the well. This can be explained by the very beneficial consequence of producing oil at the maximum rate at the lowest possible GOR, which leads to conservation of gas in the reservoir. Maintaining more gas at a higher pressure in the reservoir leads to a meaningful extension of time when the reservoir has a capacity to produce oil and avoid the situation when a substantial volume of oil remains at the reservoir but cannot be lifted up the oil well due to a diminishing bottomhole pressure.

Of course, over an extended period of time the optimal level of the bottomhole pressure may change as the reservoir formation pressure declines. Initially, such change may be compensated by adjustment of the surface choke 8 so as to keep the bottomhole pressure at the same optimal level—in this case, the opening of the surface choke 8 may paradoxically cause an increase of the bottomhole pressure because of the phenomenon of increase flow resistance as described above. Once the range of the surface choke 8 adjustments is exhausted, there may be a need to recalculate the geometry of the flow restrictor 5 and replace thereof—but that need may be encountered once every few years so that most of the time the oil well may be used for uninterrupted production of oil at high self-adjusting levels.

Figure 7:
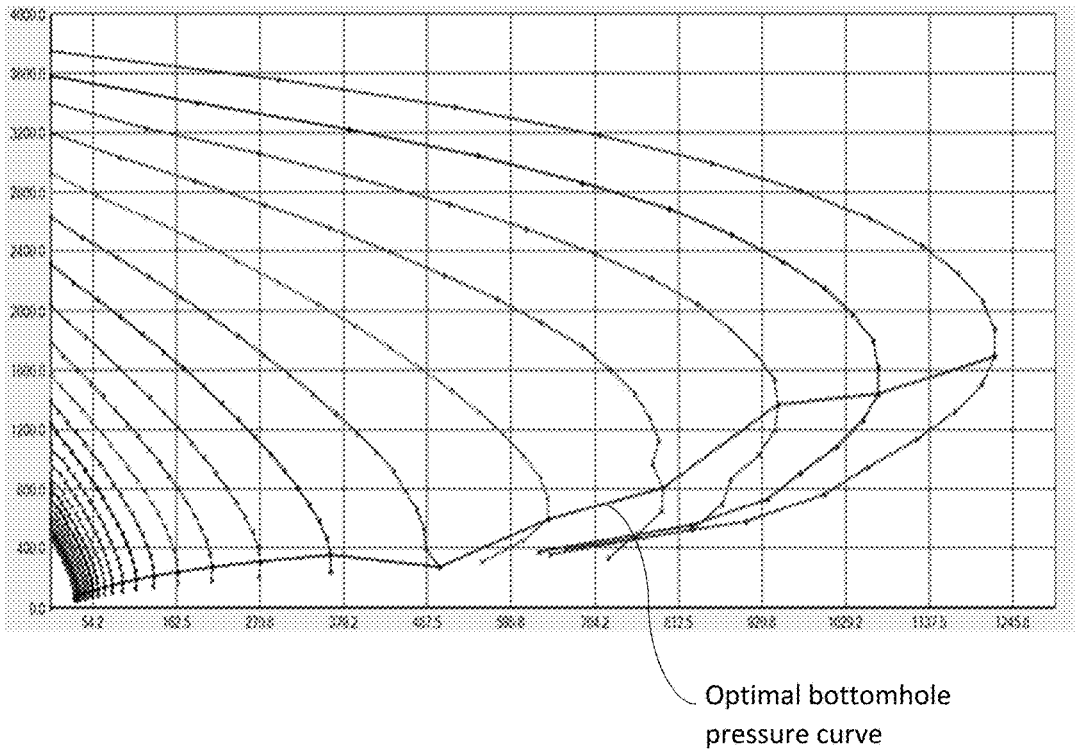
FIG. 7 is an exemplary chart showing a family of IPR curves calculated for an oil well over the lifetime thereof.

FIG. 7 shows an example of a family of IPR curves calculated for a single oil well over the lifetime thereof according to a predicted decline in reservoir pressure. The optimal level of maximum oil production is identified on each IPR curve. All such optimal levels of bottomhole pressure are connected by a curve shown in the drawing.

In the case of this particular chart, a comparison between the ultimate oil recovery under normal conditions was made with the circumstances of using the flow restrictor of the present invention. It was shown that the use of the invention allowed to increase the ultimate recovery index by as much as 5.9% via an increase of oil recovery by about 30,000 barrels, while decreasing the production of gas by about 1.2 million cubic feet. The net economic benefit in this case assuming the price of oil at $60 per barrel is close to $1.8 MM for this oil well alone.

To further lessen the burden of replacement of the flow restrictor 5, it may be deployed at the bottomhole region of the oil well using a mandrel and a cable delivery mechanism, such as for example a side pocket mandrel as described in the U.S. Pat. No. 5,740,860. In this case, retrieval of the old flow restrictor and replacement with the new flow restrictor may be accomplished without interruption of the oil production from the oil well.

Furthermore, the method of the invention may further comprise steps of determining the optimal level of the bottomhole pressure initially and then at predetermined periods over the life of the well, such as every few weeks, every month, every two months, every three months, etc. In other steps of the method, a predetermined criteria for triggering flow restrictor replacement may be used, for example when the bottomhole pressure deviates from the optimal level by a predetermined margin, for example by 10-20 percent. In other embodiments, criteria for flow restrictor replacement may be a maximum allowed predetermined threshold value of GOR, such as twice the initial value of GOR.

One other group of advantages of the present invention may be explained in comparison with other methods of stimulating oil production, namely hydraulic fracturing, or fracking. Not only the present invention may lead to an increase of as much as two times of the ultimate oil recovery from an oil well when used instead of hydraulic fracturing, but at the same time it may be accomplished at a fraction of the cost of hydraulic fracturing and, even more importantly, without any risk of environmental damage, which typically accompanies an oil well following a completion of a hydraulic fracturing process.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method of maximizing oil recovery from a reservoir with Gas-to-Oil-Ratio (GOR) at or above about 100 cubic meters of gas per cubic meters of oil via an oil well, said method comprising the following steps:

a. calculating an optimal bottomhole pressure level for said oil well so as to assure maximum oil flow from said reservoir through said oil well, b. providing a fixed geometry flow restrictor comprising at least a first stage tube and a second stage tube attached to said first stage tube in series therewith, said flow restrictor is designed to maintain said bottomhole pressure at said optimal level calculated in step (a), wherein said flow restrictor has no moving parts, said flow restrictor is characterized by a geometry selected to satisfy all of the following predetermined well-specific design criteria over the life cycle of the well:

i. a pressure drop across said flow restrictor is not exceeding 12% of a current reservoir formation pressure while said oil well is producing said oil at said maximum oil flow rate;

ii. for oil wells producing less than 100 barrels of oil per day, said first stage tube has a diameter from about 2 mm to about 4 mm and a length from about 4 cm to about 6 cm; or for oil wells producing 100 to 1,000 barrels of oil per day, said first stage tube has a diameter from about 4 mm to about 8 mm and a length from about 6 cm to about 8 cm; or for oil wells producing over 1,000 barrels of oil per day, said first stage tube has a diameter from about 8 mm to about 20 mm and a length from about 8 cm to about 10 cm; and iii. said second stage tube has a diameter about 1.05 to 1.5 times greater than the diameter of said first stage tube and a length about 0.5 to 0.95 times the length of said first stage tube, c. installing said flow restrictor at a bottom of said oil well with said first stage tube below said second stage tube, and d. producing oil at said oil well, whereby said flow restrictor passively causing said bottomhole pressure to remain at a stable equilibrium at about said optimal bottomhole pressure level and return thereto despite varying reservoir conditions.

2. The method as in claim 1, wherein said second stage tube forms a stepped enlargement in flow path diameter when transitioning from said first stage tube.

3. The method as in step 1 further including a step of determining said optimal bottomhole pressure in step (a) over the life of said oil well and a step of replacing said flow restrictor when said optimal bottomhole pressure deviates from said optimal level thereof by more than a predetermined margin.

4. The method as in claim 1, wherein said flow restrictor comprises a third stage tube located in series with said second stage tube opposite said first stage tube, said third stage tube has a diameter about 1.05 to 1.5 times greater than the diameter of said second stage tube, said third stage tube has a length about 0.5 to 0.95 times the length of said second stage tube.

5. The method as in claim 1, wherein said optimal bottomhole pressure is selected to avoid increase of said Gas-to-Oil-Ratio above a predetermined GOR threshold.

6. The method as in step 3, wherein said step of replacing said flow restrictor is conducted without interrupting oil production in said oil well.

7. The method as in claim 1, wherein said oil well further comprising a surface choke, said step (c) further including a step of adjusting said surface choke to maintain said bottomhole pressure at said optimum bottomhole pressure level.

8. The method as in claim 7, wherein said step (a) is repeated on a predetermined periodic basis to determine an updated optimum bottomhole pressure, followed by a corresponding step (c) of adjusting said surface choke to maintain said bottomhole pressure at said updated optimum bottomhole pressure level.

9. The method as in claim 8, wherein said reservoir is further characterized by said bottomhole pressure increasing upon opening of said surface choke.

10. The method as in claim 1, wherein said step (b) further comprises a step of calculating oil flow and gas flow parameters throughout said flow restrictor and said oil well by using a mathematical model of two-phase flow proceeding in three consecutive flow regimes:

iv. a first flow regime starting from said reservoir and proceeding through a first stage tube of said flow restrictor;

v. a second flow regime proceeding through said second stage tube of said flow restrictor; and vi. a third stage flow regime proceeding after exit from said second stage tube through the remaining portion of said oil well, whereby flow exit conditions from the preceding flow regime form entry conditions for the subsequent flow regime.

11. The method as in claim 10, wherein each of the first flow regime, the second flow regime, and the third flow regime are modeled using the same mathematical equations of two-phase flow in a cylindrical conduit.

12. The method as in claim 11, wherein said optimal bottomhole pressure level is calculated as a sum or respective consecutive pressure drops of said first flow regime, said second flow regime, and said third flow regime.

13. The method as in claim 10, wherein said mathematical model of two-phase flow is replaced with a mathematical model of three-phase flow when water is present in said reservoir.

14. The method as in claim 10, wherein said diameters and lengths of said respective first stage tube and said second stage tube of the flow restrictor are selected to avoid gas flow regime in said oil well.

15. The method as in claim 10, wherein said diameters and lengths of said respective first stage tube and said second stage tube of the flow restrictor are selected to avoid increasing of said Gas-to-Oil-Ratio over 2 times greater than initial level thereof.

16. The method as in claim 1, wherein said reservoir is further characterized by an inflow performance relationship curve having a maximum oil production point corresponding to said optimal bottomhole pressure level.

* * * * *